US011501892B2

(12) United States Patent
Sugita et al.

(10) Patent No.: US 11,501,892 B2
(45) Date of Patent: Nov. 15, 2022

(54) WIRE HARNESS AND RESIN COMPOSITION

(71) Applicant: Hitachi Metals, Ltd., Tokyo (JP)

(72) Inventors: Keisuke Sugita, Tokyo (JP); Masahiro Abe, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 44 days.

(21) Appl. No.: 17/215,982

(22) Filed: Mar. 29, 2021

(65) Prior Publication Data

US 2021/0304917 A1 Sep. 30, 2021

(30) Foreign Application Priority Data

Mar. 30, 2020 (JP) ..... JP2020-060236

(51) Int. Cl.

| | |
|---|---|
| ***H01B 7/18*** | (2006.01) |
| ***H01B 19/00*** | (2006.01) |
| ***H01B 7/00*** | (2006.01) |
| *H01B 3/30* | (2006.01) |

(52) U.S. Cl.

CPC ..... *H01B 7/0045* (2013.01); *H01B 7/18* (2013.01); *H01B 19/00* (2013.01); *H01B 3/302* (2013.01); *H01B 3/305* (2013.01)

(58) Field of Classification Search

CPC ..... H01B 7/0045; H01B 7/18; H01B 19/00; H01B 3/302; H01B 3/305

USPC ..... 174/72 A

See application file for complete search history.

(56) References Cited

U.S. PATENT DOCUMENTS

| | | | | |
|---|---|---|---|---|
| 9,000,301 | B2 * | 4/2015 | Hayakawa | B60R 16/0215 174/113 R |
| 10,115,498 | B2 * | 10/2018 | Heipel | H01B 13/22 |
| 10,388,428 | B2 * | 8/2019 | Nakashima | H01B 7/0045 |
| 10,399,515 | B2 * | 9/2019 | Shimizu | B60R 16/023 |
| 11,120,923 | B2 * | 9/2021 | Kim | H01B 7/0045 |
| 2017/0313265 | A1 | 11/2017 | Shimizu et al. | |
| 2018/0182511 | A1 * | 6/2018 | Tanaka | H01B 3/307 |

(Continued)

FOREIGN PATENT DOCUMENTS

JP 2016-091731 A 5/2016

*Primary Examiner* — Timothy J Thompson
*Assistant Examiner* — Michael F McAllister
(74) *Attorney, Agent, or Firm* — McGinn IP Law Group, PLLC

(57) ABSTRACT

A wire harness includes a multi-core cable including a group of cables composed of a plurality of cables, and a sheath provided around the group of cables, and a resin mold covering the group of cables at a cable branching portion where the group of cables exposed from an end of the sheath of the multi-core cable are branched. An outermost layer of each cable constituting the group of cables includes polyolefin or thermoplastic polyurethane. When the sheath includes polyolefins, the group of cables includes at least one cable including an outermost layer including thermoplastic polyurethane. When the sheath includes thermoplastic polyurethane, the group of cables includes at least one cable having an outermost layer comprising polyolefin. The resin mold includes a resin composition of a polymer alloy of a first polymer including at least one of polyamide polymer, polyester polymer, and thermoplastic polyurethane and a second polymer including polyolefin.

11 Claims, 8 Drawing Sheets

(56) References Cited

U.S. PATENT DOCUMENTS

2020/0111587 A1* 4/2020 Kim ..... H01B 7/0045
2020/0111588 A1* 4/2020 Yamamoto ..... H01B 3/308

* cited by examiner

FIG. 6

| Sample No. | | A1 | A2 | A3 | A4 | A5 | A6 | A7 | A8 | A9 | A10 | A11 | A12 | A13 | A14 | A15 | A16 | A17 | A18 |
|---|---|---|---|---|---|---|---|---|---|---|---|---|---|---|---|---|---|---|---|
| Resin mold composition | PA612 | 100 | | 80 | 70 | 70 | 70 | 60 | 50 | 40 | 30 | 20 | | | | | | | |
| | PA elastomer | | 100 | | | | | | | | | | 80 | 70 | 60 | 50 | 40 | 30 | 20 |
| | Acid-modified polyolefin | 0 | 0 | 20 | 30 | 30 | 30 | 40 | 50 | 60 | 70 | 80 | 20 | 30 | 40 | 50 | 60 | 70 | 80 |
| Average dispersion diameter (μm) | | - | - | 30 | 28 | 95 | 125 | 18 | 16 | 18 | 20 | 24 | 15 | 17 | 20 | 25 | 22 | 26 | 30 |
| Sheet adhesion evaluation (Crosslinked PE) | Peeling strength (N/mm) | 0.1 | 0.2 | 2.8 | 4.0 | 3.9 | 2.8 | 5.3 | 6.9 | 7.5 | 7.9 | 9.3 | 2.7 | 3.2 | 4.4 | 5.8 | 6.2 | 7.4 | 7.7 |
| | Peeling mode | α | α | α | β | β | α | β | β | β | β | β | α | β | B | β | β | β | β |
| Airtightness evaluation (Crosslinked PE) | | × | × | ○ | ◎ | ◎ | ○ | ◎ | ◎ | ◎ | ◎ | ◎ | ○ | ◎ | ◎ | ◎ | ◎ | ◎ | ◎ |
| Sheet adhesion evaluation (TPU) | Peeling strength (N/mm) | 9.6 | 9.3 | 9.0 | 8.8 | 8.9 | 9.2 | 8.8 | 8.0 | 7.3 | 5.9 | 4.0 | 8.9 | 9.2 | 8.3 | 7.8 | 6.7 | 5.1 | 3.8 |
| | Peeling mode | β | β | β | β | β | β | β | β | β | β | α | β | β | B | β | β | β | α |
| Airtightness evaluation (TPU) | | ◎ | ◎ | ◎ | ◎ | ◎ | ◎ | ◎ | ◎ | ◎ | ○ | × | ◎ | ◎ | ◎ | ◎ | ◎ | ○ | × |

*FIG. 7*

| Sample No. | | B1 | B2 | B3 | B4 | B5 | B6 | B7 | B8 | B9 | B10 | B11 | B12 | B13 | B14 | B15 | B16 | B17 | B18 |
|---|---|---|---|---|---|---|---|---|---|---|---|---|---|---|---|---|---|---|---|
| Resin mold composition | PBT | 100 | | 80 | 70 | 70 | 70 | 60 | 50 | 40 | 30 | 20 | | | | | | | |
| | Polyester elastomer | | 100 | | | | | | | | | | 80 | 70 | 60 | 50 | 40 | 30 | 20 |
| | Acid-modified polyolefin | 0 | 0 | 20 | 30 | 30 | 30 | 40 | 50 | 60 | 70 | 80 | 20 | 30 | 40 | 50 | 60 | 70 | 80 |
| Average dispersion diameter (μm) | | - | - | 20 | 25 | 98 | 125 | 20 | 24 | 16 | 19 | 30 | 26 | 34 | 35 | 33 | 40 | 28 | 30 |
| Sheet adhesion evaluation (Crosslinked PE) | Peeling strength (N/mm) | 0.2 | 0.2 | 3.6 | 7.8 | 5.0 | 3.0 | 7.2 | 7.6 | 7.7 | 7.0 | 7.0 | 2.9 | 3.4 | 5.8 | 6.4 | 5.2 | 5.5 | 5.1 |
| | Peeling mode | α | α | α | β | β | α | β | β | β | β | β | α | β | B | β | β | β | β |
| Airtightness evaluation (Crosslinked PE) | | × | × | ○ | ◎ | ◎ | ○ | ◎ | ◎ | ◎ | ◎ | ◎ | ○ | ◎ | ◎ | ◎ | ◎ | ◎ | ◎ |
| Sheet adhesion evaluation (TPU) | Peeling strength (N/mm) | 9.0 | 8.9 | 8.9 | 8.4 | 6.9 | 6.0 | 8.9 | 8.2 | 7.9 | 6.5 | 5.0 | 5.7 | 6.0 | 6.5 | 5.7 | 5.0 | 4.9 | 4.0 |
| | Peeling mode | β | β | β | β | β | α | β | β | β | β | α | β | β | B | β | β | β | α |
| Airtightness evaluation (TPU) | | ◎ | ◎ | ◎ | ◎ | ◎ | ○ | ◎ | ◎ | ◎ | ○ | × | ◎ | ◎ | ◎ | ◎ | ◎ | ○ | × |

FIG. 8

| Sample No. | | C1 | C2 | C3 | C4 | C5 | C6 | C7 | C8 | C9 | C10 |
|---|---|---|---|---|---|---|---|---|---|---|---|
| Resin mold composition | TPU | 100 | 80 | 70 | 70 | 70 | 60 | 50 | 40 | 30 | 20 |
| | Acid-modified polyolefin | 0 | 20 | 30 | 30 | 30 | 40 | 50 | 60 | 70 | 80 |
| Average dispersion diameter (μm) | | - | 18 | 15 | 100 | 120 | 16 | 17 | 18 | 14 | 15 |
| Sheet adhesion evaluation (Crosslinked PE) | Peeling strength (N/mm) | 0.1 | 0.7 | 9.2 | 8.8 | 5.4 | 9.2 | 9.5 | 9.0 | 8.5 | 8.8 |
| | Peeling mode | α | α | β | β | α | β | β | β | β | β |
| Airtightness evaluation (Crosslinked PE) | | × | ○ | ◎ | ◎ | ○ | ◎ | ◎ | ◎ | ◎ | ◎ |
| Sheet adhesion evaluation (TPU) | Peeling strength (N/mm) | 9.9 | 9.5 | 9.4 | 9.0 | 8.5 | 8.9 | 7.7 | 6.3 | 5.3 | 2.1 |
| | Peeling mode | β | β | β | β | α | β | β | β | β | α |
| Airtightness evaluation (TPU) | | ◎ | ◎ | ◎ | ◎ | ◎ | ◎ | ◎ | ◎ | ○ | × |

WIRE HARNESS AND RESIN COMPOSITION

CROSS-REFERENCE TO RELATED APPLICATION

The present application is based on Japanese patent application No. 2020-060236 filed on Mar. 30, 2020, the entire contents of which are incorporated herein by reference.

BACKGROUND OF THE INVENTION

1. Field of the Invention

The present invention relates to a wire harness and a resin composition.

2. Description of the Related Art

Conventionally, a composite harness including an ABS sensor cable, a parking brake cable, a sheath housing the ABS sensor cable and the parking brake cable, and a cable branching portion, in which the ABS sensor cable and the parking brake cable are pulled out from an end of the sheath and branched, and which is covered with a molding portion comprising urethane has been known (see JP2016-91731A).

According to JP2016-91731A, it is described that since the end of the sheath the ABS sensor cable, and the parking brake cable are covered by the molding portion at the cable branching portion, the water can be suppressed from entering the inside from the end of the sheath.

Patent Document 1: JP2016-91731A

SUMMARY OF THE INVENTION

However, in the composite harness described in JP2016-91731A, in order to sufficiently suppress the ingress of water from the end of the sheath, all of the sheath, the ABS sensor cable, and the parking brake cable must have high adhesion to the molding portion.

In general, for ABS sensor cables and parking brake cables, polyolefins such as crosslinked polyethylene with low adhesion to urethane are often used as insulators. JP2016-91731A does not disclose the material of the insulator for the ABS sensor cable and the parking brake cable, but when polyolefin is used, adhesion to the molding portion cannot be ensured, and water may enter into the sheath from the end of the sheath.

Therefore, the object of the present invention is to provide a wire harness in which water ingress from the cable branching portion is suppressed by a resin mold covering the cable branching portion of a group of cables even when the insulator material of the group of cables and the insulator material of the sheath are different from each other.

A further object of the present is to provide a resin composition suitable for the resin mold covering a plurality of resin molded bodies.

For the purpose of solving the above problem, one aspect of the present invention provides a wire harness comprising:

a multi-core cable comprising a group of cables composed of a plurality of cables, and a sheath provided around the group of cables; and a resin mold covering the group of cables at a cable branching portion where the group of cables exposed from an end of the sheath of the multi-core cable are branched, wherein an outermost layer of each cable constituting the group of cables comprises polyolefin or thermoplastic polyurethane, wherein when the sheath comprises polyolefins, the group of cables includes at least one cable including an outermost layer comprising thermoplastic polyurethane, and when the sheath comprises thermoplastic polyurethane, the group of cables includes at least one cable having an outermost layer comprising polyolefin, and wherein the resin mold comprises a polymer alloy of a first polymer comprising at least one of polyamide polymer, polyester polymer, and thermoplastic polyurethane and a second polymer comprising polyolefin.

Further, another aspect of the present invention provides a resin composition for a resin mold configured to cover a first resin molded body comprising polyolefin and a second resin molded body comprising thermoplastic polyurethane, comprising:

a polymer alloy of a first polymer comprising at least one of polyamide polymer, polyester polymer, and thermoplastic polyurethane and a second polymer comprising polyolefin.

Points of Invention

According to the present invention, even when the insulator material of the group of cables and the insulator material of the sheath are different from each other, a wire harness in which water ingress from the cable branching portion is suppressed by the resin mold covering the cable branching portion of the group of cables can be provided. Further, the resin composition suitable for the resin mold can be provided.

BRIEF DESCRIPTION OF THE DRAWINGS

Next, the embodiment of the present invention will be described in accordance with appended drawings:

FIG. 6 shows a composition of samples 30 with the sample numbers A1 to A18 and the results of various evaluations;

FIG. 7 shows a composition of samples 30 with the sample numbers B1 to B18 and the results of various evaluations; and FIG. 8 shows a composition of samples 30 with the sample numbers C1 to C11 and the results of various evaluations.

DETAILED DESCRIPTION OF THE PREFERRED EMBODIMENTS

Embodiments

Figure 1:
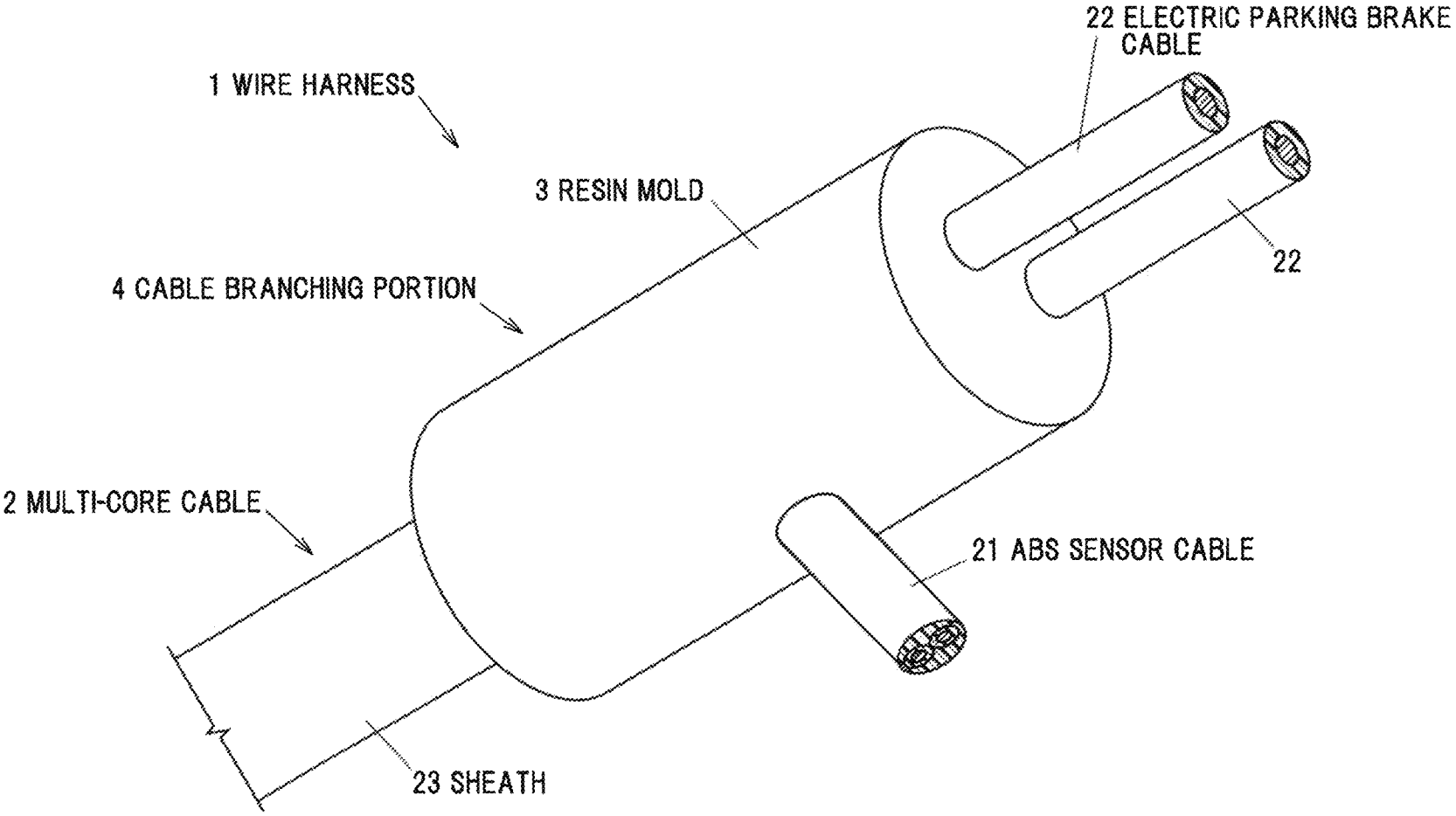
FIG. 1 is a perspective view of a peripheral portion of a cable branching portion of a wire harness according to the embodiment of the present invention.

FIG. 1 is a perspective view of a peripheral portion of a cable branching portion 4 of a wire harness 1 according to the embodiment of the present invention.

The wire harness 1 is an automotive component configured to be wired in an automobile wheelhouse, and the wire harness 1 includes a multi-core cable 2 including an ABS (anti-lock braking system) sensor cable 21, electric parking brake (EPB) cables 22, and a sheath 23 covering the ABS sensor cable 21 and the electric parking brake cables 22, and a resin mold 3 covering the sheath 23, the ABS sensor cable 21, and the electric parking brake cables 22 at a cable branching portion 4 where the ABS sensor cable 21 and the electric parking brake cables 22 exposed from an end of the sheath 23 of the multi-core cable 2 are branched, are covered, and the resin mold 3 suppresses water ingress into the multi-core cable 2 from the end of the sheath 23.

The ABS sensor cable 21 is a cable configured to be used for the anti-lock braking system of an automobile, and the ABS sensor cable 21 is a signal line which serves for signal transmission between a wheel speed sensor that detects a rotational speed of a wheel and an electronic control unit on a car body-side. For example, a connector for being connected to the wheel speed sensor is provided at a tip of the cable branching portion 4 of the ABS sensor cable 21.

The electric parking brake cable 22 is a cable configured to be used for the EPB system of the automobile, and the electric parking brake cables 22 are power supply lines that electrically connect an electric motor in a brake caliper that constitutes a disc brake in the wheelhouse and a brake control unit on the car body-side to supply an electric power for driving the brake caliper. For example, a connector for being connected to the electric motor in the brake caliper is provided at the tip of the cable branching portion 4 of the electric parking brake cables 22.

Figure 2:
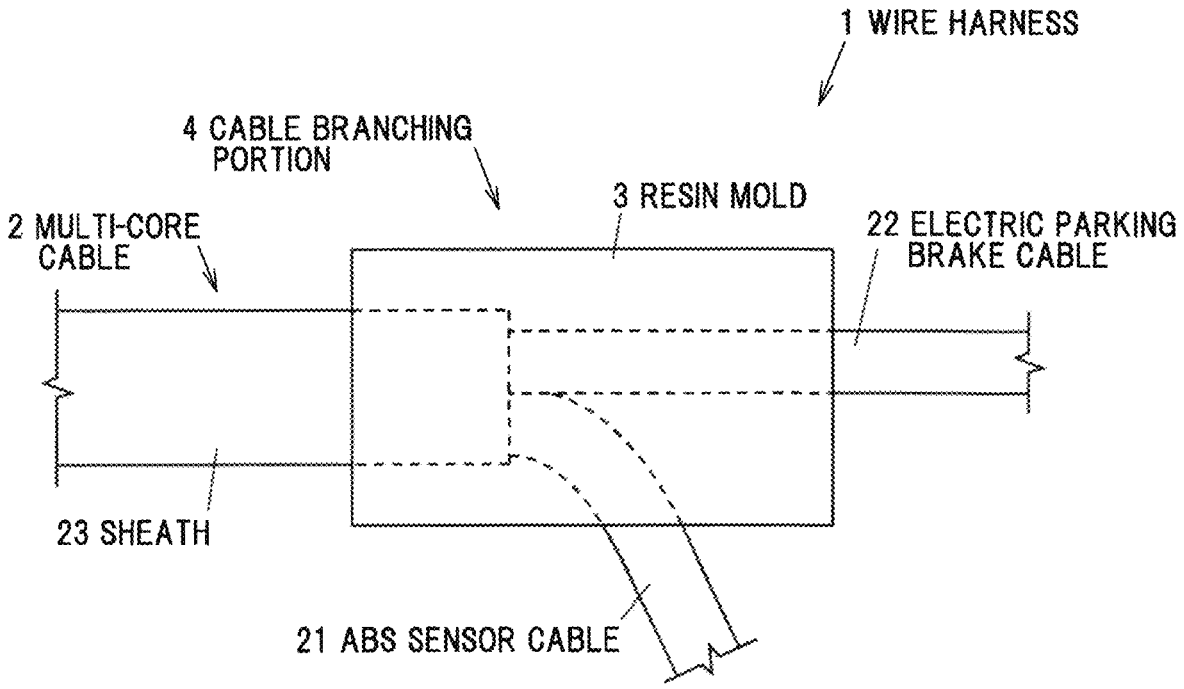
FIG. 2 is a side view of a peripheral portion of the cable branching portion of the wire harness according to the embodiment of the present invention.

FIG. 2 is a side view of a peripheral portion of the cable branching portion 4 of the wire harness 1 according to the embodiment of the present invention. The ABS sensor cable 21 and the electric parking brake cables 22, which are exposed at the end where the sheath 23 of the multi-core cable 2 is removed, are branched, and the branched portions of the ABS sensor cable 21 and the electric parking brake cables 22 are fixed with the resin mold 3, and the branched state is maintained.

In the examples shown in FIGS. 1 and 2, the electric parking brake cables 22 extend from the cable branching portion 4 along a longitudinal direction of the multi-core cable 2, and the ABS sensor cable 21 extends from the cable branching portion 4 in such a manner to be shifted (away) from the longitudinal direction of the multi-core cable 2. However, the directions (branched state) extending from the cable branching portion 4 of the ABS sensor cable 21 and the electric parking brake cables 22 are not particularly limited.

Figure 3:
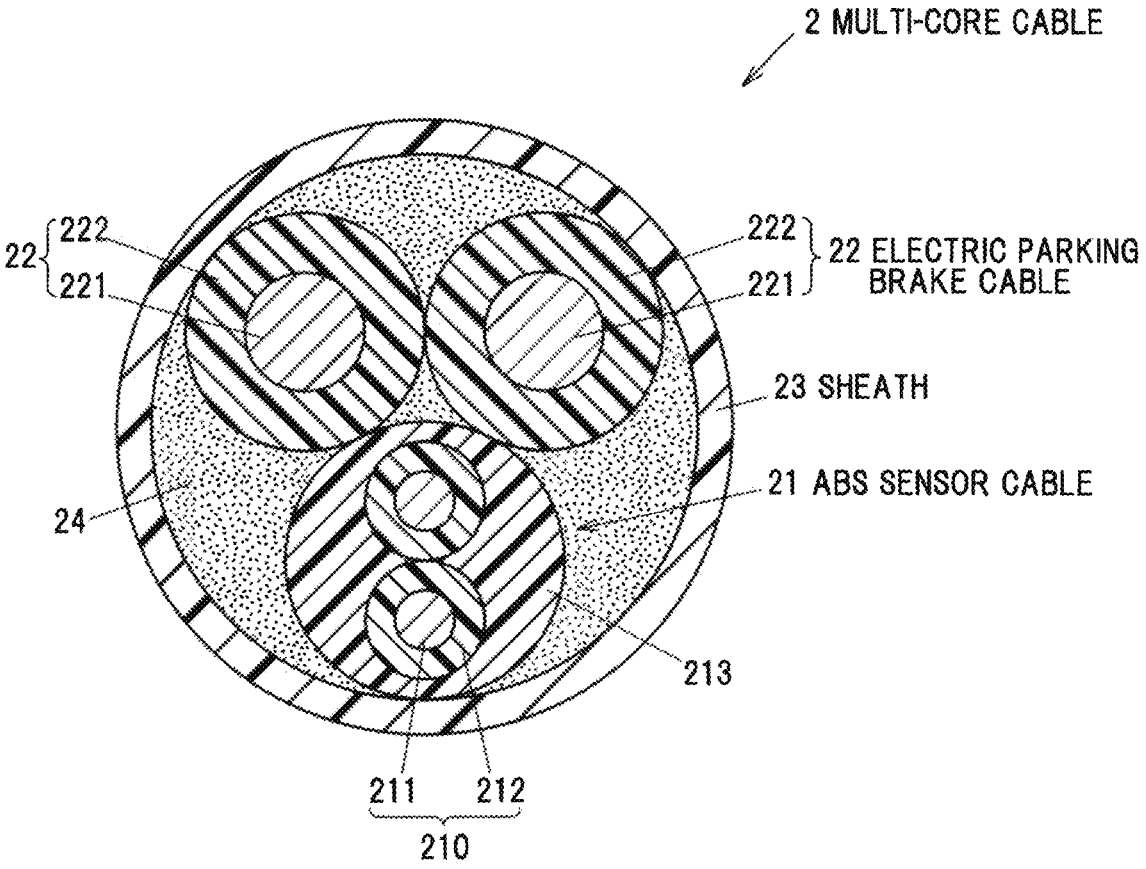
FIG. 3 is a cross-sectional view in a radial direction of a multi-core cable according to the embodiment of the present invention.

FIG. 3 is a cross-sectional view in a radial direction of the multi-core cable 2 according to the embodiment of the present invention. In the multi-core cable 2, the sheath 23 is provided around the ABS sensor cable 21 and two electric parking brake cables 22. In order to stabilize the arrangement of the ABS sensor cable 21 and the electric parking brake cables 22, a filler 24 may be provided in a gap between the ABS sensor cable 21 and the electric parking brake cables 22. Further, a binder tape may be wrapped around the ABS sensor cable 21 and the electric parking brake cables 22.

The sheath 23 comprises thermoplastic polyurethane (TPU). Further, the material of the sheath 23 may include a flame retardant to increase flame retardant property, and crosslinking may be introduced to increase heat resistance.

The ABS sensor cable 21 includes two ABS cables 210 and a sheath 213 comprising thermoplastic polyurethane and provided around the two ABS cables 210. Crosslinking may be introduced into the material of the sheath 213. The ABS cable 210 includes a linear-shape conductor 211 and an insulator 212 provided around the conductor 211. The conductor 211 comprises an electrically conductive material such as copper, and the insulator 212 comprises an insulating material such as crosslinked polyethylene and a crosslinked ethylene vinyl acetate co-polymer. The material of the insulator 212 may include a flame retardant.

The electric parking brake cable 22 includes a linear-shape conductor 221 and an insulator 222 provided around the conductor 221. The conductor 221 comprises an electrically conductive material such as copper, and the insulator 222 comprises polyolefin. For the polyolefin as the material of the insulator 222, e.g., polyethylene, crosslinked polyethylene, polypropylene, crosslinked ethylene propylene rubber, crosslinked ethylene vinyl acetate copolymer, ethylene ethyl acrylate polymer, etc., may be used. In particular, the crosslinked polyethylene or crosslinked ethylene vinyl acetate copolymer may be preferably used because it is inexpensive and excellent in terminal workability. The material of the insulator 222 may include a flame retardant.

Further, the polyolefin, which is the material of the insulator 222, may be an acid-modified polyolefin. As the acid for the acid-modified polyolefin, unsaturated carboxylic acid and derivatives thereof can be used, and more specifically, maleic anhydride can be suitably used.

The resin mold 3 comprises a polymer alloy consisting of a first polymer consisting of at least one of polyamide polymer, polyester polymer, and thermoplastic polyurethane and a second polymer consisting of polyolefin. The polymer alloys can be manufactured using a batch kneading machine such as kneader and Banbury mixer, or a continuous kneading machine such as biaxial extruder.

For the polyamide polymer used as the first polymer, e.g., polyamides such as polyamide 6, polyamide 11, polyamide 12, polyamide 66, polyamide 46, polyamide 610, polyamide 612, polyamide 6T, polyamide 61, polyamide 9T, polyamide 10T may be used, and polyamide elastomers such as copolymer of polyamide and polyether, copolymer of polyamide and polyetherester or the like, or a mixture or copolymer thereof, can be used.

For the polyester polymer used as the first polymer, e.g., polyester resins such as PBT (polybutylene terephthalate), polyester elastomers such as a copolymer of PBT and polyether, and a copolymer of PBT and polyester can be used.

For thermoplastic polyurethane used as the first polymer, it is preferable to use ether-based thermoplastic polyurethane from the viewpoint of water resistance.

For the polyolefin used as the second polymer, the polyolefins (including the acid-modified polyolefin) used as the material for the insulator 222 listed above may be used. The second polymer is preferably the acid-modified polyolefin to enhance solubleness with the first polymer.

Since the resin mold 3 includes the first polymer consisting of at least one of polyamide polymer, polyester polymer, and thermoplastic polyurethane, the resin mold 3 has high adhesion with the sheath 23 of the multi-core cable 2 and the sheath 213 of the ABS sensor cable 21, each of which is made of thermoplastic polyurethane. Further, since the resin mold 3 includes the second polymer consisting of polyolefin, the resin mold 3 has high adhesion to the insulator 222 consisting of polyolefin, which is an outermost layer member of the electric parking brake cable 22.

The resin mold 3 adheres to the sheath 23 of the multi-core cable 2, the sheath 213 of the ABS sensor cable 21, and the insulator 222 of the electric parking brake cable 22 by thermal adhesion (heat fusion), thereby suppressing the ingress of water from the cable branching portion 4 into the multi-core cable 2. Thus, in the wire harness 1, since the waterproofing of the cable branching portion 4 is ensured by the resin mold 3, there is no need to use a sealing member such as a heat shrink tube separately, and the number of manufacturing processes can be reduced and the manufacturing cost can be reduced.

The polymer alloy, which is the material of the resin mold 3, preferably includes 30 to 80 parts by mass of the first polymer and 70 to 20 parts by mass of the second polymer per the total of 100 parts of the first polymer and the second polymer. By setting the content of the first polymer to 30 parts by mass or more, the adhesion between the sheath 23 of the multi-core cable 2 and the sheath 213 of the ABS sensor cable 21, each of which is made of thermoplastic polyurethane, can be increased. On the other hand, by setting the content of the second polymer to 20 parts by mass or more, the adhesion to the insulator 222 of the electric parking brake cable 22 consisting of polyolefin can be further increased.

The phase structure of the polymer alloy that constitutes the resin mold 3 may be a phase structure consisting of a continuous phase and a dispersion phase or may be a co-continuous structure. Further, when the polymer alloy has a phase structure consisting of a continuous phase and a dispersion phase, either the first polymer or the second polymer may form a continuous phase. Usually, these phase structure differences have little effect on the adhesion of the resin mold 3 to the sheath 23 of the multi-core cable 2, the sheath 213 of the ABS sensor cable 21, and the insulator 222 of the electric parking brake cable 22.

However, in order to further enhance the adhesion of the resin mold 3 to the electric parking brake cable 22 including polyolefin in the outermost layer, when a polyamide polymer is used as the first polymer constituting the polymer alloy, which is the material of the resin mold 3, and one of the first polymer and the second polymer forms a dispersion phase, an average dispersion diameter is preferably less than 125 μm, and more preferably 95 μm or less. Further, when the polyester polymer is used as the first polymer that constitutes the polymer alloy, which is the material of the resin mold 3, and one of the first polymer and the second polymer forms a dispersion phase, the average dispersion diameter is preferably less than 125 μm, and more preferably 98 μm or less. Further, when the thermoplastic polyurethane is used as the first polymer that constitutes the polymer alloy, which is the material of the resin mold 3, and one of the first polymer and the second polymer forms a dispersion phase, it is preferable that the average dispersion diameter is less than 120 μm, and more preferably 100 μm or less. Therefore, when one of the first polymer and the second polymer forms a dispersion phase, it is preferable that the average dispersion diameter is less than 120 μm, and more preferably 95 μm or less.

Figure 4A:
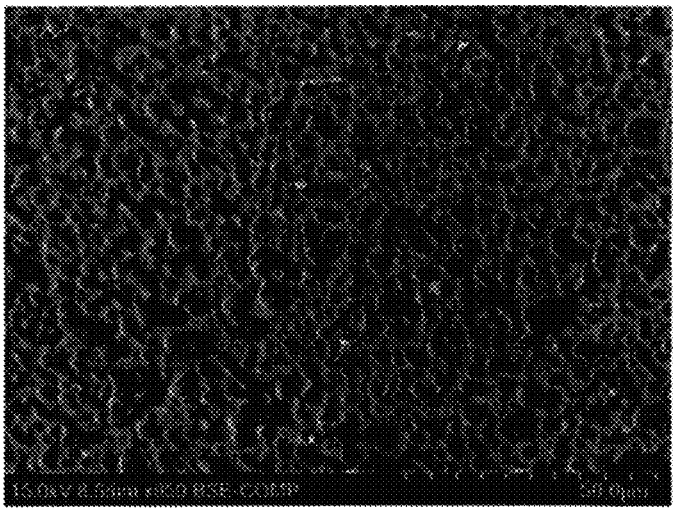
FIGS. 4A to 4C are SEM (scanning electron microscopy) observation images of the phase structure of polymer alloy between the first polymer and the second polymer.
Figure 4B:
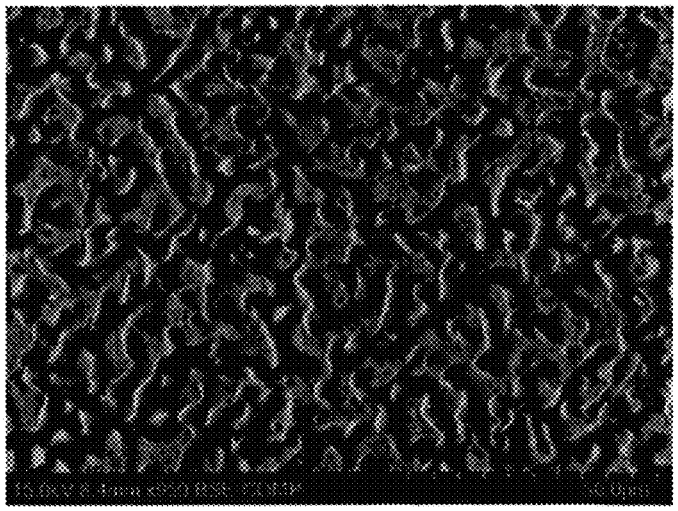
Figure 4C:
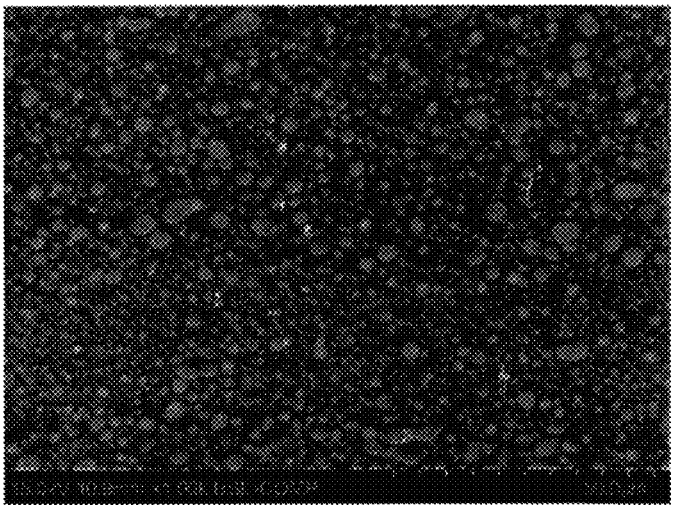

FIG. 4A is an SEM (scanning electron microscope) observation image of a phase structure of the polymer alloy in which the thermoplastic polyurethane as the first polymer forms a continuous phase and the acid-modified polyolefin as the second polymer forms a dispersion phase. FIG. 4B is an SEM observation image of a phase structure of the polymer alloy in which the thermoplastic polyurethane as the first polymer and the acid-modified polyolefin as the second polymer form a co-continuous structure. FIG. 4C is an SEM observation image of the phase structure of the polymer alloy in which the acid-modified polyolefin as the second polymer forms a continuous phase and the thermoplastic polyurethane as the first polymer forms a dispersion phase.

The average dispersion diameter can be determined, for example, in the SEM observation images of the polymer alloy phase structures as shown in FIGS. 4A to 4C, the particle size of any number of dispersed particles (for example, the average value of the large and short diameters if the particle is oval) can be determined as an average within any observation range. In changing (reducing) the average dispersion diameter, it is effective to increase the shear rate during polymer alloy kneading, and for example, a method such as raising the rotational speed of a rotor such as an extruder screw or a kneader can be adopted.

In the multi-core cable 2, two ABS cables 210 (the ABS sensor cable 21 in which the sheath 23 and the filler 24 are omitted) may be used instead of the ABS sensor cable 21. In this case, the resin mold 3 directly covers the insulator 212 of the ABS cables 210. Further, in this case, the insulator 212 is composed of polyolefin so as to ensure high adhesion with the resin mold 3. For the polyolefin used as the material of the insulator 212, polyolefins (including acid-modified polyolefin) used as the material of the insulator 222 listed above may be used.

Further, the cables constituting the group of cables included in the multi-core cable 2 are not limited to ABS sensor cable 21 or the electric parking brake cable 22, and the other cables may be used, as long as the outermost layer is made of polyolefin or thermoplastic polyurethane similarly to the ABS sensor cable 21 and the electric parking brake cable 22. Further, the number of the cables is not limited. Still further, the material of the sheath 23 of the multi-core cable 2 may be polyolefin.

That is, each outermost layer of the cable that constitutes the group of cables contained in the multi-core cable 2 is composed of polyolefin or thermoplastic polyurethane. When the sheath 23 of the multi-core cable 2 is composed of polyolefins, the group of cables would include at least one cable having an outermost layer composed of thermoplastic polyurethane, and the outermost layers of the other cables would be composed of thermoplastic polyurethane. Further, when the sheath 23 of the multi-core cable 2 is composed of thermoplastic polyurethane, the group of cables includes at least one cable having the outermost layer composed of polyolefin, and the outermost layers of the other cables are composed of thermoplastic polyurethane.

The cross-sectional shape in the radial direction of the multi-core cable 2 is typically circular as shown in FIG. 3 but is not particularly limited. Further, the resin mold 3 may be integrally molded by one-piece molding with a grommet by which the wire harness 1 is soft-mounted to the car body, and the resin mold 3 itself may form a grommet.

Effect of the Embodiment

According to the wire harness 1 in the above embodiment, the polymer alloy of the first polymer consisting of at least one of polyamide polymer, polyester polymer, and thermoplastic polyurethane and the second polymer consisting of polyolefin is used as the material for the resin mold 33. Thus, the adhesion of the resin mold 3 to the sheath 23 composed of thermoplastic polyurethane, the ABS sensor cable 21 including the outermost layer composed of thermoplastic polyurethane, and the electric parking brake cable 22 including the outermost layer composed of polyolefin can be sufficiently secured. Therefore, the ingress of water into the multi-core cable 2 from the end of the sheath 23 at the cable branching portion 4 can be effectively suppressed.

EXAMPLES

Hereinafter, the results of the test for evaluating the waterproofing in the cable branching portion 4 of the wire harness 1 according to the above embodiment will be described.

(Composition of Samples for Evaluation)

Figure 5A:
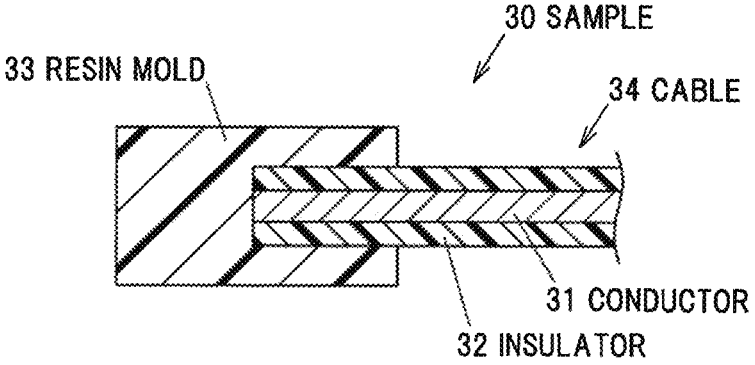
FIG. 5A is a cross-sectional view in which a main portion of a sample used for airtightness evaluation test according to the embodiment of the present invention is enlarged.

FIG. 5A is a cross-sectional view in which the main portion of a sample 30 used for the airtightness evaluation test according to this Example is enlarged. The sample 30 includes a linear-shape conductor 31, an insulator 32 that covers (coats) the outer circumference of the conductor 31, and a resin mold 33 that covers (coats) one terminal of the insulator 32.

The conductor 31 is a stranded wire composed of seven copper conductor wires each having a diameter of 0.26 mm, and air can pass through the conductor 31 inside the insulator 32. In addition, a thickness of the insulator 32 is 0.36 mm, and an outer diameter of the insulator 32 is 1.5 mm. Further, the resin mold 33 has a cylindrical shape having a diameter of 6 mm and a length of 20 mm, and an insertion length of a cable 34 into the resin mold 33 is 10 mm.

In this embodiment, as shown in FIGS. 6-8 described later, samples 30 with sample numbers A1 to A20, B1 to B18, and C1 to C11 respectively having different compositions of the resin mold 33 (type of polymer that constitutes polymer alloy, which is the material of the resin mold 33) were prepared. Each of the samples 30 of sample numbers A1 to A20, B1 to B18, and C1 to C11 further included two samples 30 in which the material of the insulator 32 is different from each other.

(Evaluation Method)

<Airtightness Test>

Airtightness test and thermal shock test were performed alternately to evaluate how long the airtightness could be maintained.

Figure 5B:
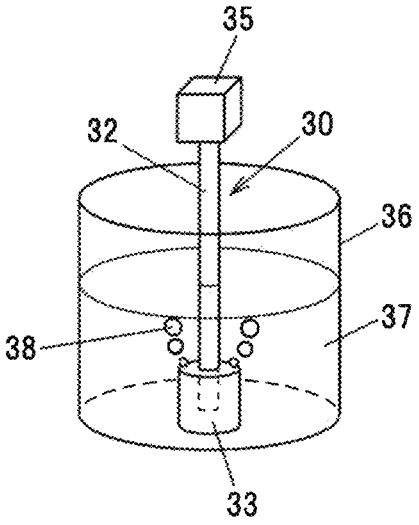
FIG. 5B is a schematic diagram representing the implementation state of the airtightness test according to the embodiment of the present invention.

FIG. 5B is a schematic diagram representing the implementation state of the airtightness test according to this Example. As shown in FIG. 5B, the end of the sample 30 on the resin mold 33 side was immersed in water 37 in a water tank 36 and connected to an air supply machine 35 at the opposite end.

In the airtightness test, it was determined that the airtightness was lost when the air supplied from the air supply machine 35 to the resin mold 33 side through the conductor 31 leaked as a bubble 38 from a bonding surface between the resin mold 33 and the insulator 32, and it was determined that airtightness was maintained when the bubble 38 was not formed. Here, in one airtightness test, 200 kPa of compressed air was supplied from the air supply machine 35 for 30 seconds.

In the thermal shock test, the sample 30 was left for 30 minutes in the atmosphere at −40° C. and 30 minutes in the atmosphere at 120° C. for 100 cycles.

That is, in this airtightness evaluation, every 100 cycles of the thermal shock test were performed, the airtightness test was performed to confirm whether the airtightness was maintained. The sample 30 endured for 2000 cycles or more of thermal shock tests at the time of loss of airtightness was judged to be "excellent" (◎) with excellent airtightness, and the sample 30 endured for 1000 or more and less than 2000 at the time of loss of airtightness was judged to be "acceptable" (○) with usable airtightness. The sample 30 endured for less than 1000 cycles at the time of loss of airtightness was determined to be "failure" (x) without usable airtightness.

<Adhesion Test>

Using a laminated sheet consisting of a sheet consisting of the material of the resin mold 33 (200 mm long×25 mm wide xl mm thick) and a sheet consisting of the material of the insulator 32 (200 mm long×25 mm wide×1 mm thick), a T-shaped peel test in accordance with JIS K6854-3 (1999) was performed and peel strength was measured. Further, when peeling was performed, it was visually confirmed whether both sheets were peeled off at the interface or whether any of the sheets were agglomerated and destroyed to peel off.

(Evaluation results) FIGS. 6-8 show the composition of the samples 30 with the sample numbers A1 to A18, B1 to B18, and C1 to C11 and the results of various evaluations. The "average dispersion diameter" in FIGS. 6-8 is the average particle size of the dispersion phase of the polymer alloy, which is the material of the resin mold 33. Further, "sheet adhesion evaluation (crosslinked PE)" indicates a sheet adhesion evaluation when the insulator 32 consists of crosslinked polyethylene in which the insulator 32 is polyolefin, and the "sheet adhesion evaluation (TPU)" indicates a sheet adhesion evaluation when the insulator 32 consists of thermoplastic polyurethane. In the "peeling mode", the "α" indicates the interface peeling and "β" indicates the agglomeration destruction.

FIG. 6 shows the compositions of the samples 30 with the sample numbers A1 to A18 and the results of various evaluations. In the samples 30 with the sample numbers A1 to A18, as the first polymer constituting the polymer alloy, which is the material of the resin mold 33, PA612 (DuPont, "Zytel 151L NC010") and PA elastomer (Arkema, "Pebax 5533") were used. As the second polymer, maleic anhydride-modified ethylene propylene rubber which is one of polyolefins (Mitsui Chemicals, "Admer XE070") (indicated as acid-modified polyolefin in FIG. 6) was used.

According to FIG. 6, for both the samples 30 with the sample numbers A1 and A2, when the material of the insulator 32 is thermoplastic polyurethane, the peel strength in the sheet adhesion evaluation is strong and the airtightness evaluation is "excellent". However, in both samples 30, when the material of the insulator 32 is crosslinked polyethylene, the peel strength in the sheet adhesion evaluation is weak and the airtightness evaluation is "failure". This is assumed that since only the first polymer is used as the material of the resin mold 33, the adhesion with thermoplastic polyurethane is sufficient but the adhesion with polyolefin is insufficient.

Further, according to the evaluation of the samples 30 with the sample numbers A3 to A18 in which the material of the resin mold 33 is composed of the polymer alloy which consists of the first polymer and the second polymer, for both the samples 30 with the sample umbers A11 and A18, when the material of the insulator 32 is crosslinked polyethylene, the peel strength in the sheet adhesion evaluation is strong and the airtightness evaluation is "excellent". However, when the material of the insulator 32 is thermoplastic polyurethane, the peel strength in the sheet adhesion evaluation is weak and the airtightness evaluation is "failure". It is assumed that since the ratio of the first polymer to the polymer alloy, which is the material of the resin mold 33, is small (the first polymer is 20 parts by mass and the second polymer is 80 parts by mass per the total of 100 parts by mass of the first polymer and the second polymer), so that the adhesion with polyolefin is sufficient but the adhesion with thermoplastic polyurethane is insufficient.

On the other hand, according to the evaluation of samples 30 with the sample numbers A3 to A18, when the polymer alloy, which is the material of the resin mold 33, includes the first polymer of 30 to 80 parts by mass and the second polymer of 70 to 20 parts by mass per the total of 100 parts by mass of the first polymer and the second polymer (in the cases of the sample numbers A3 to A10, and A12 to A17), for both the case where the material of the insulator 32 is crosslinked polyethylene and the case where the material of the insulator 32 is thermoplastic polyurethane, the judgement "acceptable" or more is obtained in the airtightness evaluation. It is assumed that the adhesion with thermoplastic polyethylene can be increased by setting the content of the first polymer to be 30 parts by mass or more, and that the adhesion with polyolefin can be increased by setting the content of the second polymer to be 20 parts by mass or more.

In addition, when the polymer alloy, which is the material of the resin mold 33, includes the first polymer of 40 to 70 parts by mass and the second polymer of 60 to 30 parts by mass per the total of 100 parts by mass of the first polymer and the second polymer (in the cases of the sample numbers A4 to A9, and A13 to A16), for both the case where the material of the insulator 32 is crosslinked polyethylene and the case where the material of the insulator 32 is thermoplastic polyurethane, the judgement "excellent" is obtained in the airtightness evaluation (in the samples with the sample numbers A4 and A5 each with relatively small average dispersion diameters among the samples 30 with the sample numbers A4 to A6 including 70 parts by mass of the first polymer and 30 parts by mass of the second polymer, for both the case where the material of the insulator 32 is crosslinked polyethylene and the case where the thermoplastic polyurethane, the judgement "excellent" is obtained). It is assumed that the adhesion with thermoplastic polyethylene can be increased by setting the content of the first polymer to be 40 parts by mass or more, and that the adhesion with polyolefin can be increased by setting the content of the second polymer to be 30 parts by mass or more.

Further, in the samples 30 with the sample numbers A4 to A6, the mass ratios of the first polymer and the second polymer in the polymer alloy, which is the material of the resin mold 33, are the same, but the average dispersion diameters of the polymer alloy are different from each other. For this reason, it is assumed that the samples 30 with the sample numbers A4 and A5 are judged to be "excellent" and the sample 30 with the sample number A6 is judged to be "acceptable" in the airtightness evaluation when the material of the insulator 32 is thermoplastic polyurethane, based on the difference in average dispersion diameter. Thus, the average dispersion diameter is preferably less than 125 μm, and more preferably 95 μm or less.

From the above results, it is confirmed that, in the wire harness 1 according to the above embodiment, when polyamide polymer is used as the first polymer that constitutes the polymer alloy as the material of the resin mold 3, the adhesion of the resin mold 3 with the sheath 23 composed of thermoplastic polyurethane, the ABS sensor cable 21 including the outermost layer composed of thermoplastic polyurethane, and the electric parking brake cable 22 including the outermost layer composed of polyolefin can be sufficiently obtained.

FIG. 7 shows the compositions of the samples 30 with the sample numbers B1 to B18 and the results of various evaluations. In the samples 30 with the sample numbers B1 to B18, as the first polymer constituting the polymer alloy, which is the material of the resin mold 33, PBT (polybutylene terephthalate) (Toray, "Traycon 1401X06") and polyester elastomer (DuPont-Toray, "Hytrel 3046") (indicated as polyester elastomer in FIG. 7) were used. As the second polymer, maleic anhydride-modified ethylene propylene rubber which is one of polyolefins (Mitsui Chemicals, "Admer XE070") and PA elastomer (Arkema, "Pebax 5533") were used. As the second polymer, maleic anhydride-modified ethylene propylene rubber which is one of polyolefins (Mitsui Chemicals, "Admer XE070") (indicated as acid-modified polyolefin in FIG. 7) was used.

According to FIG. 7, for both the samples 30 with the sample numbers B1 and B2, when the material of the insulator 32 is thermoplastic polyurethane, the peel strength in the sheet adhesion evaluation is strong and the airtightness evaluation is "excellent". However, in both samples 30, when the material of the insulator 32 is crosslinked polyethylene, the peel strength in the sheet adhesion evaluation is weak and the airtightness evaluation is "failure". This is assumed that since only the first polymer is used as the material of the resin mold 33, the adhesion with thermoplastic polyurethane is sufficient but the adhesion with polyolefin is insufficient.

Further, according to the evaluation of the samples 30 with the sample numbers B3 to B18 in which the material of the resin mold 33 is composed of the polymer alloy which consists of the first polymer and the second polymer, for both the samples 30 with the sample umbers B11 and B18, when the material of the insulator 32 is crosslinked polyethylene, the peel strength in the sheet adhesion evaluation is strong and the airtightness evaluation is "excellent". However, when the material of the insulator 32 is thermoplastic polyurethane, the peel strength in the sheet adhesion evaluation is weak and the airtightness evaluation is "failure". It is assumed that since the ratio of the first polymer to the polymer alloy, which is the material of the resin mold 33, is small (the first polymer is 20 parts by mass and the second polymer is 80 parts by mass per the total of 100 parts by mass of the first polymer and the second polymer), so that the adhesion with polyolefin is sufficient but the adhesion with thermoplastic polyurethane is insufficient.

On the other hand, according to the evaluation of samples 30 with the sample numbers B3 to B18, when the polymer alloy, which is the material of the resin mold 33, includes the first polymer of 30 to 80 parts by mass and the second polymer of 70 to 20 parts by mass per the total of 100 parts by mass of the first polymer and the second polymer (in the cases of the sample numbers B3 to B10, and B12 to B17), for both the case where the material of the insulator 32 is crosslinked polyethylene and the case where the material of the insulator 32 is thermoplastic polyurethane, the judgement "acceptable" or more is obtained in the airtightness evaluation. It is assumed that the adhesion with thermoplastic polyethylene can be increased by setting the content of the first polymer to be 30 parts by mass or more, and that the adhesion with polyolefin can be increased by setting the content of the second polymer to be 20 parts by mass or more.

In addition, when the polymer alloy, which is the material of the resin mold 33, includes the first polymer of 40 to 70 parts by mass and the second polymer of 60 to 30 parts by mass per the total of 100 parts by mass of the first polymer and the second polymer (in the cases of the sample numbers B4 to B9, and B13 to B16), for both the case where the material of the insulator 32 is crosslinked polyethylene and the case where the material of the insulator 32 is thermoplastic polyurethane, the judgement "excellent" is obtained in the airtightness evaluation (in the samples with the sample numbers B4 and B5 each with relatively small average dispersion diameters among the samples 30 with the sample numbers B4 to B6 including 70 parts by mass of the first polymer and 30 parts by mass of the second polymer, for both the case where the material of the insulator 32 is crosslinked polyethylene and the case where the thermoplastic polyurethane, the judgement "excellent" is obtained). It is assumed that the adhesion with thermoplastic polyethylene can be increased by setting the content of the first polymer to be 40 parts by mass or more, and that the adhesion with polyolefin can be increased by setting the content of the second polymer to be 30 parts by mass or more.

Further, in the samples 30 with the sample numbers B4 to B6, the mass ratios of the first polymer and the second polymer in the polymer alloy, which is the material of the resin mold 33, are the same, but the average dispersion diameters of the polymer alloy are different from each other. For this reason, it is assumed that the samples 30 with the sample numbers B4 and B5 are judged to be "excellent" and the sample 30 with the sample number B6 is judged to be "acceptable" in the airtightness evaluation when the material of the insulator 32 is thermoplastic polyurethane, based on the difference in average dispersion diameter. Thus, the average dispersion diameter is preferably less than 125 μm, and more preferably 98 μm or less.

From the above results, it is confirmed that, in the wire harness 1 according to the above embodiment, when polyamide polymer is used as the first polymer that constitutes the polymer alloy as the material of the resin mold 3, the adhesion of the resin mold 3 with the sheath 23 composed of thermoplastic polyurethane, the ABS sensor cable 21 including the outermost layer composed of thermoplastic polyurethane, and the electric parking brake cable 22 including the outermost layer composed of polyolefin can be sufficiently obtained.

FIG. 8 shows the compositions of the samples 30 with the sample numbers C1 to C10 and the results of various evaluations. In the samples 30 with the sample numbers C1 to C10, as the first polymer constituting the polymer alloy, which is the material of the resin mold 33, thermoplastic polyurethane (TPU) (BASF, "Elastollan 1190A") was used. As the second polymer, maleic anhydride-modified ethylene propylene rubber which is one of polyolefins (Mitsui Chemicals, "Admer XE070") (indicated as acid-modified polyolefin in FIG. 8) was used.

According to Table 3 FIG. 8, when the material of the insulator 32 is crosslinked polyethylene, the peel strength in the sheet adhesion evaluation is weak and the airtightness evaluation is "failure". It is assumed that adhesion with polyolefin is insufficient since only the first polymer is used as the material of the resin mold 33.

Further, according to the evaluation of the samples 30 with the sample numbers C3 to C10 in which the material of the resin mold 33 is composed of the polymer alloy which consists of the first polymer and the second polymer, when the material of the insulator 32 is crosslinked polyethylene, the peel strength in the sheet adhesion evaluation is strong and the airtightness evaluation is "excellent". However, when the material of the insulator 32 is thermoplastic polyurethane, the peel strength in the sheet adhesion evaluation is weak and the airtightness evaluation is "failure". It is assumed that since the ratio of the first polymer to the polymer alloy, which is the material of the resin mold 33, is small (the first polymer is 20 parts by mass and the second polymer is 80 parts by mass per the total of 100 parts by mass of the first polymer and the second polymer), so that the adhesion with polyolefin is sufficient but the adhesion with thermoplastic polyurethane is insufficient.

On the other hand, according to the evaluation of samples 30 with the sample numbers C2 to C10, when the polymer alloy, which is the material of the resin mold 33, includes the first polymer of 30 to 80 parts by mass and the second polymer of 70 to 20 parts by mass per the total of 100 parts by mass of the first polymer and the second polymer (in the cases of the sample numbers C2 to C29), for both the case where the material of the insulator 32 is crosslinked polyethylene and the case where the material of the insulator 32 is thermoplastic polyurethane, the judgement "acceptable" or more is obtained in the airtightness evaluation. It is assumed that the adhesion with thermoplastic polyethylene can be increased by setting the content of the first polymer to be 30 parts by mass or more, and that the adhesion with polyolefin can be increased by setting the content of the second polymer to be 20 parts by mass or more.

In addition, when the polymer alloy, which is the material of the resin mold 33, includes the first polymer of 40 to 70 parts by mass and the second polymer of 60 to 30 parts by mass per the total of 100 parts by mass of the first polymer and the second polymer (in the cases of the sample numbers C3 to C8), for both the case where the material of the insulator 32 is crosslinked polyethylene and the case where the material of the insulator 32 is thermoplastic polyurethane, the judgement "excellent" is obtained in the airtightness evaluation (in the samples with the sample numbers C3 and C4 each with relatively small average dispersion diameters among the samples 30 with the sample numbers C3 to C5 including 70 parts by mass of the first polymer and 30 parts by mass of the second polymer, for both the case where the material of the insulator 32 is crosslinked polyethylene and the case where the thermoplastic polyurethane, the judgement "excellent" is obtained). It is assumed that the adhesion with thermoplastic polyethylene can be increased by setting the content of the first polymer to be 40 parts by mass or more, and that the adhesion with polyolefin can be increased by setting the content of the second polymer to be 30 parts by mass or more.

Further, in the samples 30 with the sample numbers C3 to C5, the mass ratios of the first polymer and the second polymer in the polymer alloy, which is the material of the resin mold 33, are the same, but the average dispersion diameters of the polymer alloy are different from each other. For this reason, it is assumed that the samples 30 with the sample numbers C3 and C4 are judged to be "excellent" and the sample 30 with the sample number C5 is judged to be "acceptable" in the airtightness evaluation when the material of the insulator 32 is thermoplastic polyurethane, based on the difference in average dispersion diameter. Thus, the average dispersion diameter is preferably less than 125 μm, and more preferably 100 μm or less.

From the above results, it is confirmed that, in the wire harness 1 according to the above embodiment, when polyamide polymer is used as the first polymer that constitutes the polymer alloy as the material of the resin mold 3, the adhesion of the resin mold 3 with the sheath 23 composed of thermoplastic polyurethane, the ABS sensor cable 21 including the outermost layer composed of thermoplastic polyurethane, and the electric parking brake cable 22 including the outermost layer composed of polyolefin can be sufficiently obtained.

Summary of the Embodiment

Next, the technical idea grasped from the embodiment described above will be described using signs, etc. in the embodiment. Provided, however, that each sign, etc. in the following description is not limited to a member or the like that specifically shows the element within the scope of the claim in the mode of embodiment.

[1] A wire harness (1) comprising:

a multi-core cable (2) comprising a group of cables (21, 22) composed of a plurality of cables, and a sheath (23) provided around the group of cables (21, 22); and a resin mold (3) covering the group of cables (21, 22) at a cable branching portion (4) where the group of cables (21, 22) exposed from an end of the sheath (23) of the multi-core cable (2) are branched, wherein an outermost layer of each cable constituting the group of cables (21, 22) comprises polyolefin or thermoplastic polyurethane, wherein when the sheath (23) comprises polyolefins, the group of cables (21, 22) includes at least one cable including an outermost layer comprising thermoplastic polyurethane, and when the sheath (23) comprises thermoplastic polyurethane, the group of cables (21, 22) includes at least one cable having an outermost layer comprising polyolefin, and wherein the resin mold (3) comprises a polymer alloy of a first polymer comprising at least one of polyamide polymer, polyester polymer, and thermoplastic polyurethane and a second polymer comprising polyolefin.

[2] The wire harness (1) according to [1], wherein the polyolefin constituting the outermost layer of the at least one cable is a crosslinked polyethylene or crosslinked ethylene vinyl acetate copolymer.

[3] The wire harness (1) according to [1] or [2], wherein the second polymer is an acid-modified polyolefin.

[4] The wire harness (1) according to any of [1] to [3], wherein the polymer alloy includes 30 to 80 parts by mass of the first polymer and 70 to 20 parts by mass of the second polymer per the total of 100 parts by mass of the first polymer and the second polymer.

[5] The wire harness (1) according to any of [1] to [4], wherein an average dispersion diameter of the polymer alloy is less than 120 μm.

[6] The wire harnesses (1) according to any one of [1] to [5], wherein the group of cables (21, 22) includes an ABS sensor cable (21) and an electric parking brake cable (22).

[7] The wire harnesses (1) according to any one of [1] to [5], wherein the polymer alloy includes 40 to 70 parts by mass of the first polymer and 60 to 30 parts by mass of the second polymer per the total of 100 parts of the first polymer and the second polymer.

As described above, the embodiments and examples of the present invention have been described, but the present invention is not limited to the above embodiments and examples, and various modifications can be performed within the range that does not go beyond the gist of the invention. Further, the embodiments and examples described above do not limit the invention pertinent to the scope of the claims. It should also be noted that not all combinations of features described in the embodiments and examples are essential to the means for solving the problems of the invention.

For example, a resin composition for a resin mold configured to cover a first resin molded body comprising polyolefin and a second resin molded body comprising thermoplastic polyurethane may comprise a polymer alloy of a first polymer comprising at least one of polyamide polymer, polyester polymer, and thermoplastic polyurethane and a second polymer comprising polyolefin.

The second polymer is an acid-modified polyolefin.

The polymer alloy includes 30 to 80 parts by mass of the first polymer and 70 to 20 parts by mass of the second polymer per the total of 100 parts by mass of the first polymer and the second polymer.

An average dispersion diameter of the polymer alloy is less than 120 μm.

What is claimed is:

1. A wire harness comprising:

a multi-core cable comprising a group of cables composed of a plurality of cables, and a sheath provided around the group of cables; and a resin mold covering the group of cables at a cable branching portion where the group of cables exposed from an end of the sheath of the multi-core cable are branched, wherein an outermost layer of each cable constituting the group of cables comprises polyolefin or thermoplastic polyurethane, wherein when the sheath comprises polyolefins, the group of cables includes at least one cable including an outermost layer comprising thermoplastic polyurethane, and when the sheath comprises thermoplastic polyurethane, the group of cables includes at least one cable having an outermost layer comprising polyolefin, and wherein the resin mold comprises a polymer alloy of a first polymer comprising at least one of polyamide polymer, polyester polymer, and thermoplastic polyurethane and a second polymer comprising polyolefin.

2. The wire harness according to claim 1, wherein the polyolefin constituting the outermost layer of the at least one cable is a crosslinked polyethylene or crosslinked ethylene vinyl acetate copolymer.

3. The wire harness according to claim 1, wherein the second polymer is an acid-modified polyolefin.

4. The wire harness according to claim 1, wherein the polymer alloy includes 30 to 80 parts by mass of the first polymer and 70 to 20 parts by mass of the second polymer per the total of 100 parts by mass of the first polymer and the second polymer.

5. The wire harness according to claim 1, wherein an average dispersion diameter of the polymer alloy is less than 120 μm.

6. The wire harnesses according to claim 1, wherein the group of cables includes an ABS sensor cable and an electric parking brake cable.

7. The wire harnesses according to claim 1, wherein the polymer alloy includes 40 to 70 parts by mass of the first polymer and 60 to 30 parts by mass of the second polymer per the total of 100 parts of the first polymer and the second polymer.

8. A resin composition for a resin mold configured to cover a first resin molded body comprising polyolefin and a second resin molded body comprising thermoplastic polyurethane, comprising:

a polymer alloy of a first polymer comprising at least one of polyamide polymer, polyester polymer, and thermoplastic polyurethane and a second polymer comprising polyolefin.

9. The resin composition according to claim 8, wherein the second polymer is an acid-modified polyolefin.

10. The resin composition according to claim 8, wherein the polymer alloy includes 30 to 80 parts by mass of the first polymer and 70 to 20 parts by mass of the second polymer per the total of 100 parts by mass of the first polymer and the second polymer.

11. The resin composition according to claim 8, wherein an average dispersion diameter of the polymer alloy is less than 120 μm.

* * * * *